US008177689B2

(12) United States Patent
Rutten

(10) Patent No.: US 8,177,689 B2
(45) Date of Patent: May 15, 2012

(54) OXYGEN TRAINER DEVICE

(76) Inventor: Bas Rutten, Thousand Oaks, CA (US)

( * ) Notice: Subject to any disclaimer, the term of this patent is extended or adjusted under 35 U.S.C. 154(b) by 57 days.

(21) Appl. No.: 12/714,703

(22) Filed: Mar. 1, 2010

(65) Prior Publication Data

US 2011/0212811 A1 Sep. 1, 2011

(51) Int. Cl.
*A63B 23/18* (2006.01)

(52) U.S. Cl. ..... 482/13

(58) Field of Classification Search ..... 482/13; 128/207.16, 200.24
See application file for complete search history.

(56) References Cited

U.S. PATENT DOCUMENTS

| | | | | |
|---|---|---|---|---|
| 4,221,381 | A | 9/1980 | Ericson | |
| 4,533,137 | A * | 8/1985 | Sonne | 482/13 |
| 4,601,465 | A * | 7/1986 | Roy | 482/13 |
| 4,739,987 | A * | 4/1988 | Nicholson | 482/13 |
| 4,770,413 | A * | 9/1988 | Green | 482/13 |
| 4,854,574 | A | 8/1989 | Larson et al. | |
| 4,973,047 | A | 11/1990 | Norell | |
| 4,981,295 | A | 1/1991 | Belman et al. | |
| 5,451,190 | A * | 9/1995 | Liardet | 482/13 |
| 5,658,221 | A | 8/1997 | Hougen | |
| 5,890,998 | A * | 4/1999 | Hougen | 482/13 |
| 5,899,832 | A | 5/1999 | Hougen | |
| 6,083,141 | A | 7/2000 | Hougen | |
| 6,165,105 | A | 12/2000 | Boutellier et al. | |
| 6,450,969 | B1 | 9/2002 | Farr et al. | |
| 6,500,095 | B1 | 12/2002 | Hougen | |
| 2007/0119449 | A1 * | 5/2007 | Boehm et al. | 128/95.1 |
| 2008/0096728 | A1 | 4/2008 | Foley et al. | |

* cited by examiner

*Primary Examiner* — Fenn Mathew
(74) *Attorney, Agent, or Firm* — Stetina Brunda Garred & Brucker

(57) ABSTRACT

An oxygen trainer assembly for use in athletic activities to increase inspiratory muscular endurance, the assembly comprising: a mouthpiece having a mouthpiece opening; a circulation chamber housing having a circulation chamber in fluid communication with the mouthpiece opening; a first endcap having a first endcap aperture and a second endcap having a second endcap opening in fluid communication with the circulation chamber housing; a first endcap insert disposable in the first endcap operative to control the level of air resistance in the assembly during inhalation and exhalation; a one-way valve disposable in the second endcap sized and configured to allow the flow of air away from the circulation chamber during exhalation.

19 Claims, 3 Drawing Sheets

OXYGEN TRAINER DEVICE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to an oxygen trainer for use by athletes to increase their inspiratory muscular endurance.

The restriction of airflow into the mouth and lungs during athletic or aerobic conditioning enables the body to adjust to a higher level of functioning with less oxygen. This may in turn strengthen the lungs by improving their aspiratory muscular endurance. Short of engaging in strenuous exercise or training at high altitude, it is difficult to simulate the incremental restriction of airflow into the lungs in order to achieve improved aspiratory muscular endurance.

It is understood that there are prior art devices that can simulate the restriction of airflow into the lungs in order to activate respiratory muscle endurance training. For instance, U.S. Patent Application No. 2008/0096728 discloses a respiratory muscle endurance training device wherein a duck-bill valve is used as a slit valve. U.S. Pat. Nos. 5,658,221, 5,899,832, 6,083,141, and 6,500,095 all disclose portable personal breathing apparatus that have a pair of coaxial cylinders each having slots which can be selectively aligned or misaligned to provide differing breathing resistance. U.S. Pat. No. 6,450,969 discloses a device for measuring inspiratory strength which uses a series of slots and holes to provide differing breathing resistance. U.S. Pat. No. 4,739,987 discloses a respiratory exerciser having a plurality of holes which are radially offset from the center of a circular base to affect regulation of breathing resistance. U.S. Pat. No. 4,601,465 discloses a device for stimulating the human respiratory system wherein a perforated disc having plural apertures may be removably mounted to the portable device to regulate breathing resistance. However, it is understood that none of these devices disclose removable resilient inserts whose openings have varying dimensions that provide a variable resistance for increased inspiratory muscular endurance both during the intake and exhaust of oxygen.

Accordingly, there is a need in the art for an oxygen trainer assembly having application to various athletic or aerobic training activities that can be readily modified to provide a variable resistance for oxygen intake and exhaust in order to increase inspiratory muscular endurance while at the same time being portable, convenient to clean, relatively inexpensive, and reliable.

BRIEF SUMMARY

According to an aspect of the present invention, there is provided an oxygen trainer assembly for use during athletic and/or an aerobic training to increase inspiratory muscular endurance. The oxygen trainer assembly includes a mouthpiece having a mouthpiece opening. The assembly further includes a circulation chamber housing having a circulation chamber in fluid communication with the mouthpiece opening. The circulation chamber housing may have a first chamber housing end and a second chamber housing end. The first chamber housing end may have a first circulation aperture and the second chamber end may have a second circulation aperture. The assembly may also include a first endcap mountable to the first chamber housing end. The first endcap may have a first endcap aperture in fluid communication with the first circulation aperture. The assembly may further include a second endcap mountable to the second chamber housing end. The second endcap may have a second endcap opening in fluid communication with the second circulation aperture. The assembly may further include a first endcap insert disposable in the first endcap. The first endcap insert may have a first endcap insert opening. The first endcap insert opening may be aligned between and in fluid communication with the first endcap aperture and the first circulation aperture. The first endcap insert opening may be sized and configured to control the level of air resistance into the circulation chamber during inhalation and out of the circulation chamber during exhalation. The assembly may further include a one-way valve disposable in the second endcap. The one-way valve may be sized and configured to allow the flow of air from the second circulation aperture and away from the circulation chamber during exhalation. The one-way valve may also block the flow of air from the second circulation aperture and into the circulation chamber during inhalation.

The oxygen trainer assembly is innovative in that the level of air resistance between the first endcap and the first chamber housing end may be readily modified by mere insertion of the first endcap insert. The dimensions of the first endcap insert opening may either increase or decrease the air resistance into and out of the circulation chamber housing at the first chamber housing end. For example, the larger the first endcap insert opening, the less resistance there may be to the passage of air through the first chamber end housing during the inhalation and exhalation of air. The oxygen trainer assembly is further innovative in that its component parts may be relatively easy to assemble and disassemble, are portable, and may be conveniently cleaned. As such, the oxygen trainer assembly may be adopted to a variety of different aerobic and athletic training activities, and may be maintained in a hygienic condition. Finally, based on the relative simplicity of its design, the operation of the oxygen trainer assembly is reliable for purposes of increasing or decreasing the level of air resistance in order to improve inspiratory muscular endurance.

In another embodiment, the oxygen trainer assembly may have a mouthpiece with a mouthpiece channel mounted to the circulation chamber housing. The mouthpiece opening may be disposed proximate the mouthpiece channel. With the oxygen trainer assembly disposed in the mouth of the user, oxygen may pass into the mouthpiece opening, through the mouthpiece channel, and into the circulation chamber housing upon the exhalation of oxygen. This process would be reversed upon the intake of oxygen.

The oxygen trainer assembly may further include a first tab extending from the first chamber housing end and a second tab extending from the second chamber housing end. The first circulation aperture may be disposed on the first tab and the second circulation aperture may be disposed on the second tab.

In another embodiment of the present invention, the first circulation aperture and the second circulation aperture may be circular. In a further embodiment, the first tab and the second tab on the circulation chamber housing may have a square configuration. In this embodiment, the first endcap may also have a square shape sized and configured to be mountable onto the first tab. Also, the second endcap may have a square shape sized and configured to be mountable onto the second tab. Likewise, the first endcap insert may have a square shape sized and configured to be disposable in the first endcap. Also, the one-way valve may also have a square shape sized and configured to be disposable in the second endcap. However, it is contemplated within the scope of the present invention that the oxygen trainer assembly may have a first tab, a second tab, a first endcap, a second endcap, a first endcap insert, and a one-way valve of any shape that is suitable to enable the convenient adjustment of the resistance of air passing into and out of the circulation chamber housing.

According to yet another embodiment of the present invention, the first endcap aperture may be circular. In a further embodiment, the second endcap opening may be rectangular. However, it is contemplated within the scope of the present invention that the oxygen trainer assembly may have a first endcap aperture and a second endcap opening of any shape that is suitable to enable the controlled passage of air into and out of the circulation chamber housing.

In one embodiment of the oxygen trainer assembly, the first endcap insert opening may have a cross-sectional area less than or equal to each of a cross-sectional area of the first endcap aperture and a cross-sectional area of the first circulation aperture.

In another embodiment of the oxygen trainer assembly, the first endcap insert opening may be circular and may have a first end cap insert radius. In another embodiment, the circular first endcap insert opening may further have a horizontal slit and a vertical slit generally orthogonal to and bisecting the horizontal slit. This feature uniquely enables the horizontal slit and the vertical slit to serve as intermediary level settings of aspiratory muscular endurance training by enabling more airflow to pass through the first endcap insert opening than would otherwise occur by use of a first endcap insert having a smaller first endcap insert opening, but less airflow than would be allowed by a first endcap insert having a larger first endcap insert opening. In another embodiment, the oxygen trainer assembly may use one of a plurality of first endcap inserts, each such first endcap insert being sized and configured to control the level of air resistance into and out of the circulation chamber housing during the inhalation and exhalation of oxygen. As discussed above, this feature uniquely enables the setting of the oxygen resistance in the oxygen trainer to be readily adjusted, thereby customizing the level of desired inspiratory endurance training for different athletic or aerobic activities.

In a further embodiment, the first endcap insert opening may be a first endcap insert slit operative to control the level of air resistance into and out of the circulation chamber housing during the inhalation and exhalation of oxygen. The first endcap insert opening may have a second endcap insert slit generally orthogonal to and bisecting the first endcap insert slit. In another embodiment, the oxygen trainer assembly may utilize one of a plurality of first endcap inserts. Each first endcap insert may have a different thickness operative to control the level of air resistance into and out of the circulation chamber housing during the inhalation and exhalation of oxygen.

The first endcap insert may be made of rubber. Likewise, the second end cap insert may also be made of rubber. However, it is contemplated within the scope of the present invention that the oxygen trainer assembly may have a first end cap insert and a second endcap insert made of any resilient material that is suitable to enable the convenient adjustment of air resistance into and out of the circulation chamber housing during air intake and exhaust that can be readily cleaned, and that is breathable.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The drawings referred to herein are for the purposes of illustrating the preferred embodiments of the present invention and not for the purpose of limiting the same.

Figure 1:
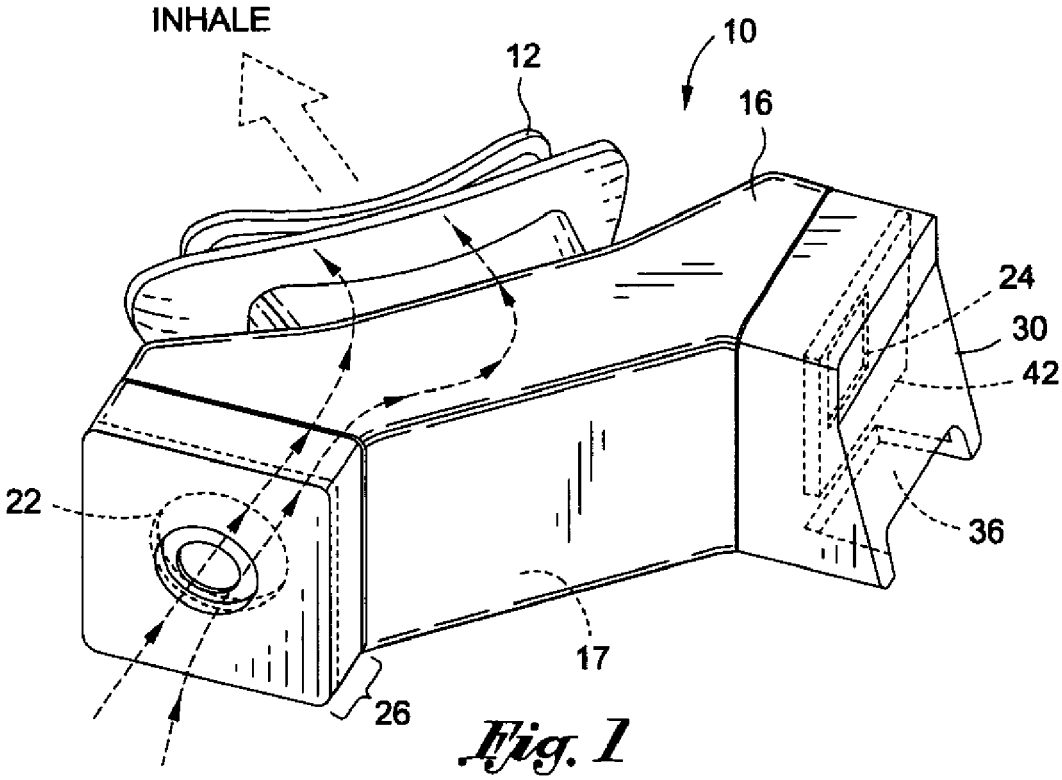
FIG. 1 is a perspective view of the oxygen trainer assembly in use during the inhalation of air.
Figure 2:
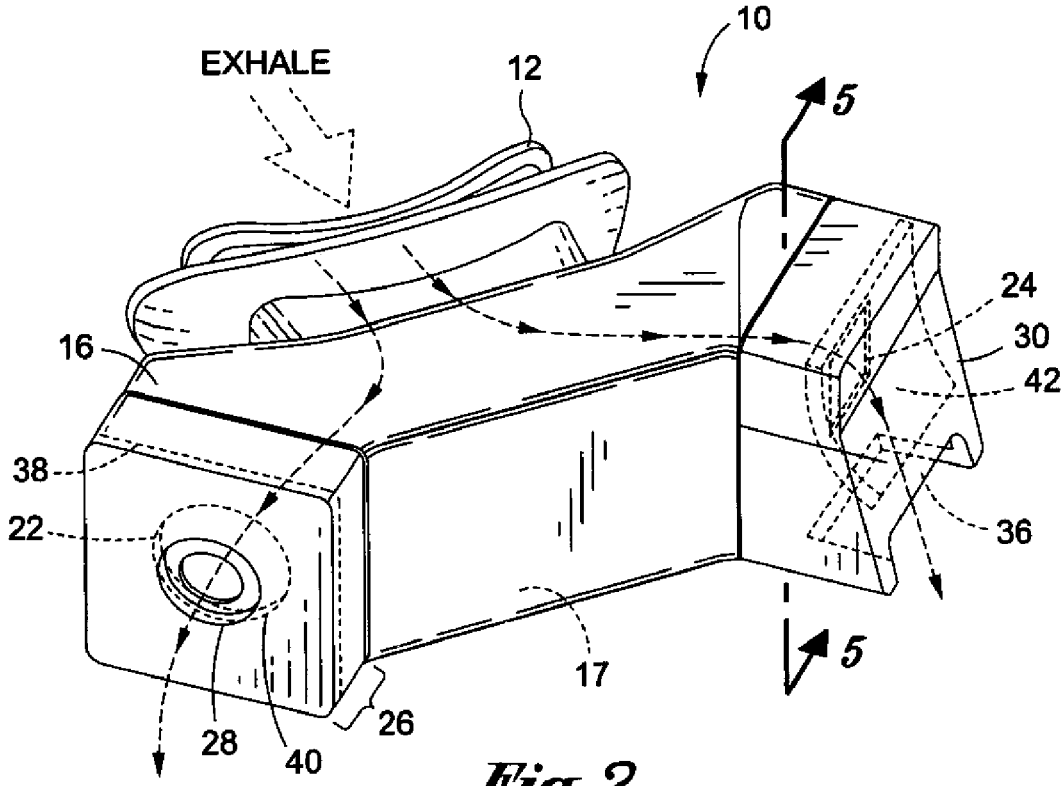
FIG. 2 is a perspective view of the oxygen trainer assembly in use during the exhalation of air.
Figure 3:
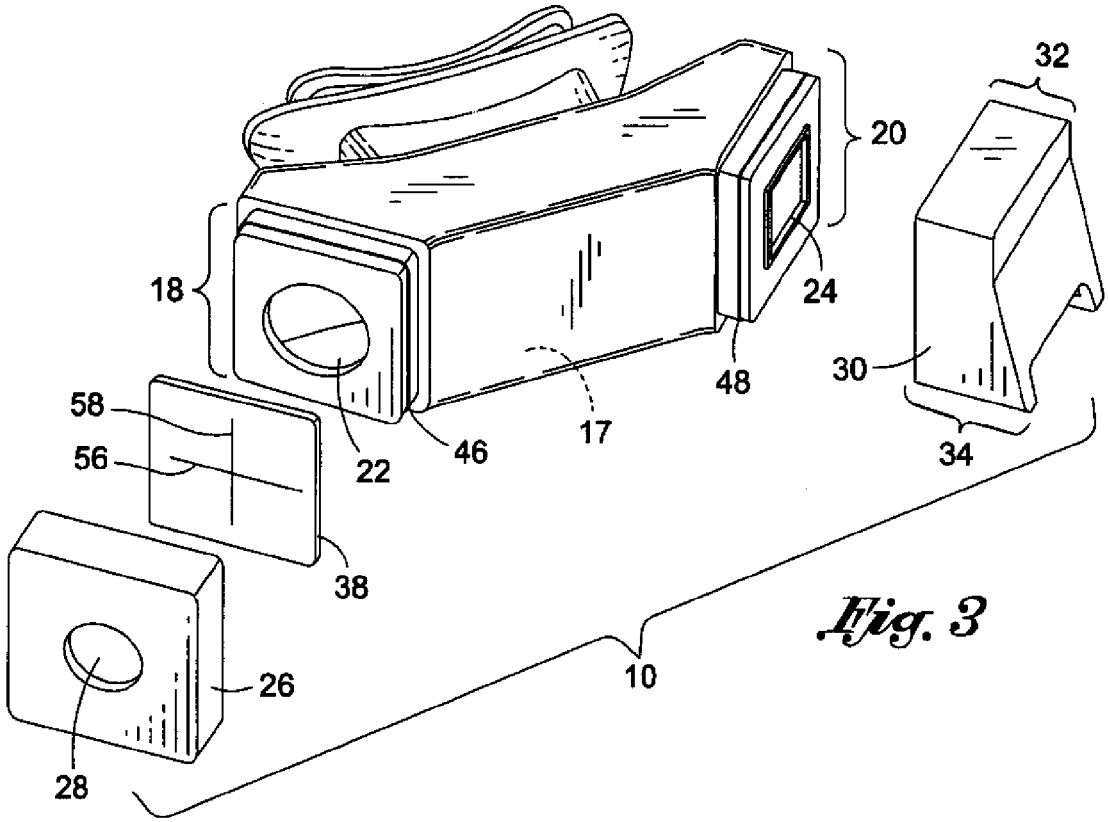
FIG. 3 is a perspective view of an embodiment of the oxygen trainer assembly depicting a first endcap insert opening with a first endcap insert slit and a second endcap insert slit generally orthogonal to and bisecting the first endcap insert slit, a first endcap mountable to a first tab on the first chamber end, and a second endcap mountable to the second tab on the second chamber end.

The oxygen trainer assembly 10 may have a mouthpiece 12 with a mouthpiece opening 14. (See FIG. 3). The oxygen trainer assembly 10 may further have a circulation chamber housing 16 with a circulation chamber 17 in fluid communication with the mouthpiece opening 14 (see FIG. 1-3). The circulation chamber housing 16 may have a first chamber housing end 18 and a second chamber housing end 20. The first chamber housing end 18 may have a first circulation aperture 22 and the second chamber housing end 20 may have a second circulation aperture 24 (see FIG. 3). The oxygen trainer assembly 10 may further have a first endcap 26 mountable to the first chamber housing end 18. The first endcap 26 may have a first endcap aperture 28 in fluid communication with the first circulation aperture 22 (see FIG. 3). In FIGS. 1-3, the first endcap 26 is shown mounted or mountable to the first chamber housing end 18. The oxygen trainer assembly 10 may further have a second endcap 30 mountable to the second chamber housing end 20. In the embodiment shown in FIGS. 3 and 5, the second endcap 30 may have a first depth 32 and an opposing second depth 34 wider than the first depth 32. In FIGS. 1-3, the second endcap 30 is shown mounted or mountable to the second chamber end 20. The second endcap 30 may have a second endcap opening 36 in fluid communication with the second circulation aperture 24 (see FIGS. 1 and 2). As shown in the embodiment of the oxygen trainer assembly 10 depicted in FIGS. 1 and 2, the second endcap opening 36 may be disposed proximate the bottom of the second endcap 30.

Figure 4:
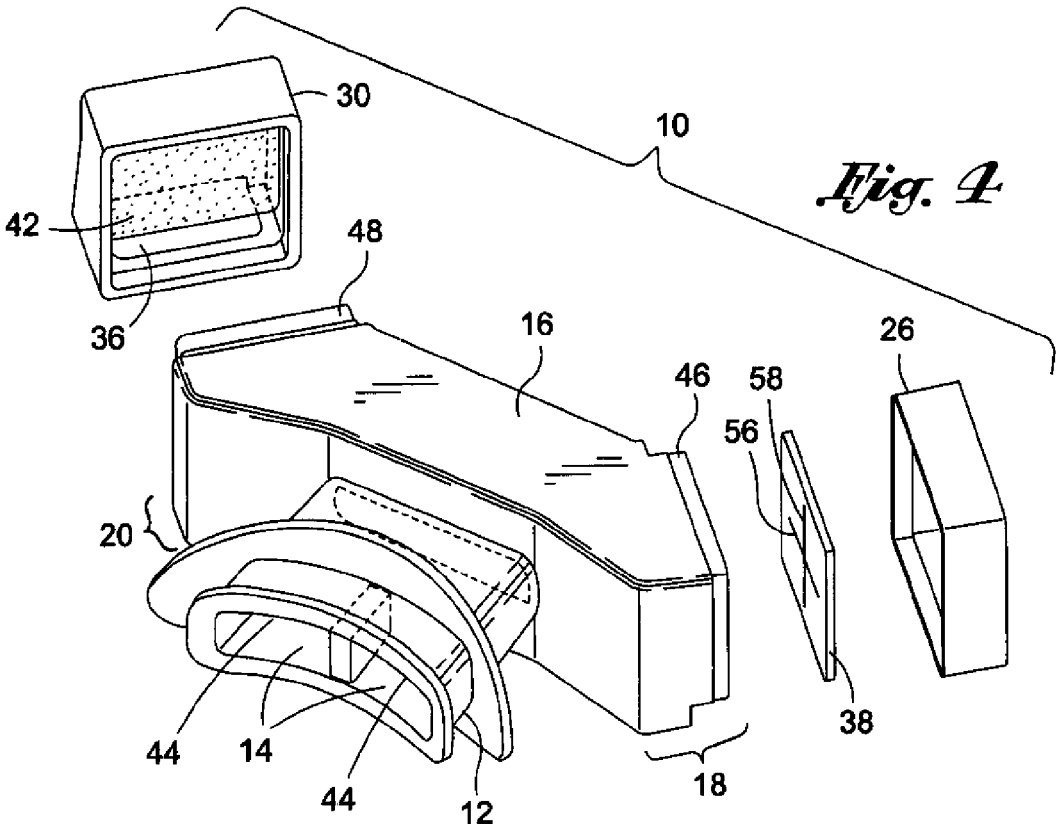
FIG. 4 is a top view of an embodiment of the oxygen trainer assembly using a first endcap insert having a first endcap insert slit and a second endcap insert slit.

The oxygen trainer assembly 10 may further include a first endcap insert 38 disposable in the first endcap 26. The first endcap insert 38 may have a first endcap insert opening 40. The first endcap insert opening 40 may be aligned between and in fluid communication with the first endcap aperture 28 and the first circulation aperture 22. The first endcap insert opening 40 may be sized and configured to control the level of air resistance into the circulation chamber 17 during inhalation and out of the circulation chamber during exhalation. (See FIGS. 1-3). In the embodiment depicted in FIGS. 1, 2, and 6, the first endcap insert 38 may have a first endcap insert opening 40 that is circular in shape. In this embodiment, the first end cap insert opening 40 may have a first endcap insert radius 50. In yet a further embodiment, the first endcap insert opening 40 may be circular and also have a horizontal slit 62 and a vertical slit 64 that is generally orthogonal to and bisects the horizontal slit 62. (See FIG. 7). In this embodiment of the oxygen trainer assembly, the horizontal slit 62 and the vertical slit 64 uniquely serve as intermediary level settings of aspiratory muscular endurance training by enabling more air flow to pass through the first endcap insert opening 40 than would otherwise occur by use of a first endcap insert 38 having a smaller first endcap insert opening 40, but less air flow than would be allowed by a first endcap insert 38 having a larger first endcap insert opening 40. As shown in FIGS. 3 and 4, the first endcap insert opening 40 may alternatively be a first endcap insert slit 56 and a second endcap insert slit 58 that is generally orthogonal to and bisects the first endcap insert slit 56. However, it is contemplated within the scope of the present invention that the oxygen trainer assembly 10 may have a first endcap insert opening 40 of any shape that is suitable to control the level of air resistance into the circulation chamber 17 during inhalation and out of the circulation chamber 17 during exhalation.

Figure 5:
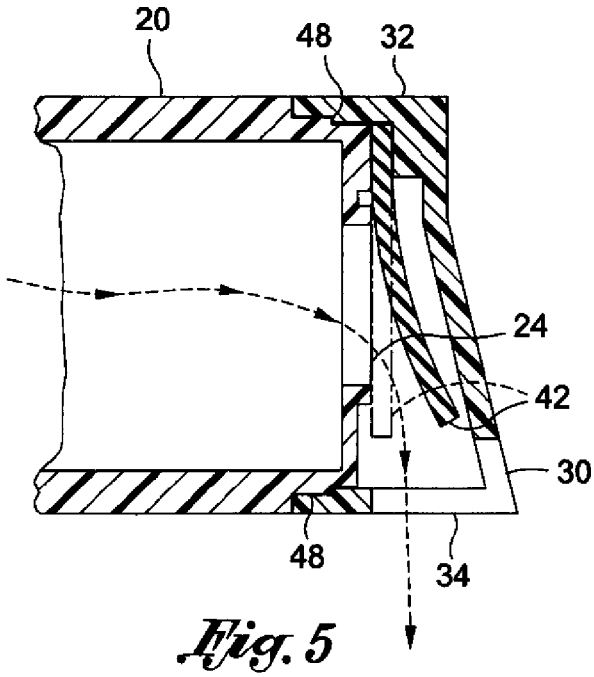
FIG. 5 is a side view of a second chamber end with the second endcap mounted to the second tab on the second chamber end, showing the second endcap insert deployed in a sealed position disposed against the second circulation aperture during the intake of oxygen and the second endcap insert deployed in an open position away from the second circulation aperture during the exhaust of oxygen.

The oxygen trainer assembly 10 may further have a one-way valve 42 disposable in the second endcap 30. (See FIGS. 2 and 4). As shown in FIGS. 2 and 5, the one-way valve 42 may be sized and configured to allow the flow of air from the second circulation aperture 24 and away from the circulation chamber 17 during exhalation. As show in FIG. 1, the one-way valve 42 may be sized and configured to block the flow of air from the second circulation aperture 24 and into the circulation chamber 17 during inhalation. As such, during the intake of oxygen, there is complete resistance to the passage of airflow through the second circulation aperture 24 caused by the blockage of the second circulation aperture 24 by the one-way valve 42. In one embodiment, the one-way valve 42 may be fitted between the second endcap 30 and the second circulation aperture 24 such that the one-way valve 42 may be able to freely move at one end with the passage of air through the second circulation aperture 24 during exhalation. (See FIG. 5). In the embodiment depicted in FIG. 5, the top portion of the one-way valve 42 is shown fitted between the second chamber end 20 and the second endcap 30, thereby allowing the bottom of the one-way valve 42 to freely move away from the second circulation aperture 24 and toward the back of the second endcap 30 during exhalation. In the embodiment shown in FIG. 5, a second depth 34 is shown to be disposed at the bottom of the second endcap 30, thereby giving the one-way valve 42 space to allow the movement of the flow of air from the second circulation aperture 24 and away from the circulation chamber 17 during exhalation. A first depth 32 is shown disposed at the top of the second endcap 30. However, it is also contemplated that the second depth 34 may be positioned at the top of the second endcap 30 with the bottom portion of the one-way valve 42 fitted between the second chamber end 20 and the second endcap insert 42.

As discussed above, the oxygen trainer assembly 10 is innovative in that the level of air resistance between the first endcap 26 and the first chamber end 18 may be readily modified by the mere insertion of the first endcap insert 38, with the first endcap insert opening 40 being disposably aligned between and in fluid communication with the first endcap aperture 28 and the first circulation aperture 22. The size of the first endcap insert opening 40 may therefore control the level of air resistance into the circulation chamber 17 during inhalation and exhalation. For example, with a larger circular first endcap insert opening 40 with a longer first endcap insert radius 50 (see FIG. 5), the air resistance may be decreased into and out of the circulation chamber 17 during the inhalation. Likewise, a first endcap insert opening 40 having a shorter first endcap insert radius 50 may increase the level of air resistance into and out of the circulation chamber 17 during inhalation or exhalation.

The oxygen trainer assembly 10 is further innovative in that its component parts may be relatively easy to assemble and disassemble, are portable, and may be able to be conveniently cleaned. As such, the oxygen trainer assembly 10 may be adopted to a variety of different aerobic and athletic training activities and may be maintained in a hygienic condition so as to reduce the transmission of germs through the mouthpiece 12. The oxygen trainer assembly 10 may reliably control the level of air resistance through the circulation apertures 22, 24 in order to improve the user's inspiratory muscular endurance during training.

In the embodiment of the oxygen trainer assembly depicted in FIG. 4, the oxygen trainer assembly 10 may have a mouthpiece 12 with a mouthpiece channel 44 mounted to the circulation chamber housing 16. The mouthpiece opening 14 may be disposed proximate the mouthpiece channel 44.

In the embodiment depicted in FIGS. 3 and 4, the oxygen trainer assembly 10 may further include a first tab 46 extending from the first chamber housing end 18 and a second tab 48 extending from the second chamber housing end 20. The first circulation aperture 22 may be disposed on the first tab 46 and the second circulation aperture 24 may be disposed on the second tab 48. The first endcap 26 may be mounted on the first tab 46 and the second endcap 30 may be mounted on the second tab 48 (see FIGS. 3 and 4). The first tab 46 and the second tab 38 on the circulation chamber 16 may have a square configuration. In this embodiment, the first endcap 26 may also have a square shape sized and configured to be mountable onto the first tab 46. Also, the second endcap 30 may have a square shape sized and configured to be mountable onto the second tab 48. Likewise, the first endcap insert 40 may have a square shape sized and configured to be disposable in the first endcap 26. In this embodiment, the one-way valve 42 may also have a square shape sized and configured to be disposable in the second endcap 30. However, it is contemplated within the scope of the present invention that the first tab 46 and the second tab 48, the first endcap 26 and the second endcap 30, and the first endcap insert 38 and the one-way valve 42 may be of any size and shape that is suitable to enable the control of the level of air resistance at the first circulation aperture 22 and the second circulation aperture 24 of the circulation chamber housing 16 during inhalation and exhalation.

As shown in the embodiment depicted in FIGS. 1-3, the first circulation aperture 22 and the second circulation aperture 24 may be circular. In this embodiment, the first endcap aperture 28 may also be circular. As shown in FIGS. 1 and 2, the second endcap opening 36 may be rectangular. However, it is contemplated within the scope of the present invention that the first circulation aperture 22 and the second circulation aperture 24, the first endcap aperture 28, and the second endcap opening 36 may be of any size and shape that is suitable to enable the convenient and reliable adjustment of air resistance into and out of the circulation chamber 17 during air intake and exhaust.

As suggested by FIGS. 3-4, and 6-7, the first endcap insert opening 40 may have a cross-sectional area less than or equal to each of a cross-sectional area of the first endcap aperture 28 and a cross-sectional area of the first circulation aperture 22. The reduced cross-sectional area of the first endcap insert opening 40 as compared to the first endcap aperture 28 and the first circulation aperture 22 enables the user to experience increased air resistance upon inhalation and exhalation so as to increase their aspiratory muscular endurance. This feature may uniquely enable the oxygen trainer assembly 10 to simulate the affects of high-altitude training to improve aspiratory muscular endurance.

The first endcap insert 38 may be made of rubber. Likewise, the one-way valve 42 may also be made of rubber. However, it is contemplated within the scope of the present invention that the oxygen trainer assembly 10 may have a first endcap insert 38 and a one-way valve 42 made of any resilient material that is suitable to enable the convenient adjustment of air resistance into and out of the circulation chamber 17 during air intake and exhaust, that can be readily cleaned, and that is breathable.

Figure 6:
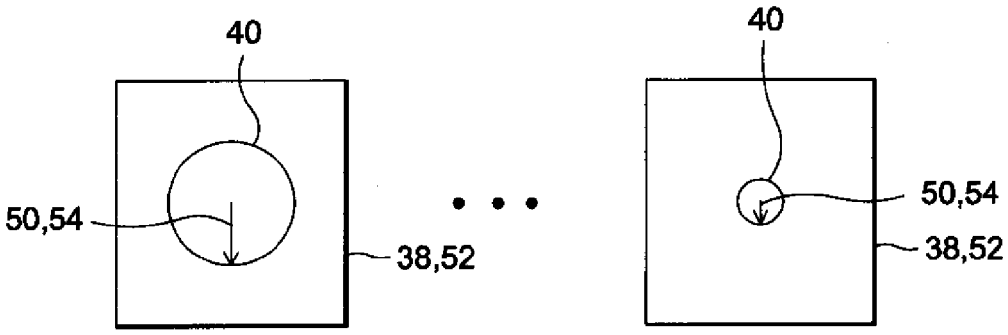
FIG. 6 is a frontal view of a plurality of first endcap inserts, each having a different first endcap insert radius, with a longer first endcap insert radius found in a first endcap insert having a larger first endcap insert opening.
Figure 7:
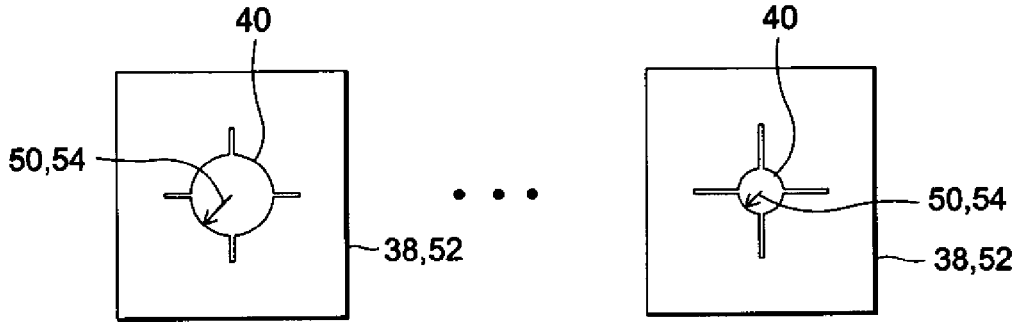
FIG. 7 is a further embodiment of the oxygen trainer assembly having a plurality of first endcap inserts whose openings are circular and have a horizontal slit and a vertical slit generally orthogonal to and bisecting the horizontal slit.

As shown in FIGS. 6 and 7, the oxygen trainer assembly 10 may also use one of a plurality of first endcap inserts 38, 52, each first endcap insert 38, 52 being sized and configured with a first endcap insert opening 40 and a first endcap insert radius 54 operative to control the level of air resistance into and out of the circulation chamber 17 during inhalation and exhalation. This feature uniquely enables the setting of the oxygen resistance in the oxygen trainer assembly 10 to be readily adjusted, thereby customizing the level of desired inspiratory endurance training to different sports or aerobic activities. For example, the first endcap insert opening 40 may range from as large as 14 mm (with a first endcap insert radius 54 of approximately 7 mm) to as little as 5 mm (with a first endcap insert radius 54 of approximately 2.50 mm). The first endcap insert 38 may be numerically arranged from numbers 1 to 10, with first endcap insert no. 1 having a first endcap insert radius 54 of 7 mm and first endcap insert no. 10 having a first endcap insert radius 54 of 2.50 mm. As discussed above, the oxygen trainer assembly 10 may have a first endcap insert opening 40 that is a first endcap slit 56 and a second endcap insert slit 58 in lieu of a circular opening 40 (see FIGS. 3-4). The second endcap insert slit 58 may be generally orthogonal to and bisect the first endcap insert slit 56. The first endcap slit 56 and the second endcap insert slit 58 are operative to control the level of air resistance into and out of the circulation chamber housing 16 during inhalation and exhalation. The oxygen trainer assembly 10 may use one of a plurality of first endcap inserts 52 wherein the first endcap insert opening 40 is a first endcap insert slit 56 and a second endcap insert slit 58 orthogonal to and bisecting the first endcap insert slit 56. The thickness of the first endcap insert 38 may be modified to enable the setting of the oxygen resistance into and out of the circulation chamber housing 16 to be readily adjusted for the desired intake and exhaust of oxygen during different athletic or aerobic activities.

In another embodiment of the claimed invention, the plurality of first endcap inserts 38, 52 may also include in addition to a circular first endcap insert opening 40 a horizontal slit 62 and a vertical slit 64 proximate the first endcap insert opening 40. As discussed above, these first endcap inserts 38, 52 have an intermediary size first endcap insert opening 40 between these first endcap inserts 38, 52 having a larger circular first endcap insert opening 40 and a smaller circular first endcap insert opening 40. This configuration of the oxygen trainer assembly 10 uniquely enables the user to incrementally increase or decrease the level of air resistance into the circulation chamber 16, thereby enabling convenient adjustment of the oxygen trainer assembly 10 to vary the desired level of inspiratory muscular endurance training. (See FIGS. 6 and 7).

What is claimed is:

1. An oxygen trainer assembly comprising:

a mouthpiece having a mouthpiece opening;

a circulation chamber housing having a circulation chamber in fluid communication with the mouthpiece opening, the circulation chamber housing having a first chamber housing end and a second chamber housing end, the first chamber housing end having a first circulation aperture and the second chamber housing end having a second circulation aperture;

a first endcap mountable to the first chamber housing end, the first endcap having a first endcap aperture in fluid communication with the first circulation aperture;

a second endcap mountable to the second chamber housing end, the second endcap having a second endcap opening in fluid communication with the second circulation aperture;

a plurality of first flat endcap inserts, each of the first flat endcap inserts being disposable between first chamber housing end and the first endcap, each of the first flat endcap inserts having a first endcap insert opening, the first endcap insert opening having bisecting slits to allow air therethrough, each of the plurality of first flat endcap inserts having different thicknesses to provide it different level of air resistance; and a one-way valve disposable between the second chamber housing end and the second endcap, the one-way valve being sized and configured to allow the flow of air from the second circulation aperture and away from the circulation chamber during exhalation and to block the flow of air from the second circulation aperture and into the circulation chamber during inhalation.

2. The oxygen trainer as claimed in claim 1, wherein the mouthpiece has a mouthpiece channel mounted to the circulation chamber housing, the mouthpiece opening being disposed proximate the mouthpiece channel.

3. The oxygen trainer as claimed in claim 1 further includes a first tab extending from the first chamber housing end and a second tab extending from the second chamber housing end, the first circulation aperture disposed on the first tab and the second circulation aperture disposed on the second tab.

4. The oxygen trainer as claimed in claim 1, wherein the second endcap opening is rectangular.

5. The oxygen trainer as claimed in claim 1, wherein the first circulation aperture and the second circulation aperture are circular.

6. The oxygen trainer as claimed in claim 3, wherein the first tab and the second tab have a square configuration.

7. The oxygen trainer as claimed in claim 6, wherein the second endcap has a square shape sized and configured to be mountable onto the second tab.

8. The oxygen trainer as claimed in claim 6, wherein the first endcap has a square shape sized and configured to be mountable onto the first tab.

9. The oxygen trainer as claimed in claim 7, wherein the one-way valve has a square shape sized and configured to be disposable in the second endcap.

10. The oxygen trainer as claimed in claim 8, wherein the first endcap insert has a square shape sized and configured to be disposable in the first endcap.

11. The oxygen trainer as claimed in claim 1, wherein the first endcap aperture is circular.

12. The oxygen trainer as claimed in claim 1, wherein the first endcap insert opening has a cross-sectional area less than or equal to each of a cross-sectional area of the first endcap aperture and a cross-sectional area of the first circulation aperture.

13. The oxygen trainer as claimed in claim 1, wherein the first endcap insert opening is circular with a first endcap insert radius.

14. The oxygen trainer as claimed in claim 1, wherein the first endcap insert is made of rubber.

15. The oxygen trainer as claimed in claim 1, wherein the second endcap insert is made of rubber.

16. The oxygen trainer as claimed in claim 1, wherein the bisecting slits are generally orthogonal to each ether.

17. The oxygen trainer as claimed in claim 1 wherein the opening further has an aperture located on the horizontal and/or vertical slit.

18. The oxygen trainer as claimed in claim 1 wherein the first endcap is removably attachable to the first chamber housing end to provide for convenient exchange of any one of the plurality of first endcap inserts.

19. A method of using an oxygen trainer assembly, the method comprising the steps of:

providing an oxygen trainer assembly comprising:

a mouthpiece having a mouthpiece opening;

a circulation chamber housing having a circulation chamber in fluid communication with the mouthpiece opening, the circulation chamber housing having a first chamber housing end and a second chamber housing end, the first chamber housing end having a first circulation aperture and the second chamber housing end having a second circulation aperture;

a first endcap mountable to the first chamber housing end, the first endcap having a first endcap aperture in fluid communication with the first circulation aperture;

a second endcap mountable to the second chamber housing end, the second endcap having a second endcap opening in fluid communication with the second circulation aperture;

a plurality of first flat endcap inserts, each of the first flat end cap inserts being disposable between first chamber housing end and the first endcap, each of the first flat endcap inserts having a first endcap insert opening, the first endcap insert opening having bisecting slits to allow air therethrough, each of the plurality of first flat endcap inserts having different thicknesses to provide a different level of air resistance; and a one-way valve disposable between the second chamber housing end and the second endcap, the one-way valve being sized and configured to allow the flow of air from the second circulation aperture and away from the circulation chamber during exhalation and to block the flow of air from the second circulation aperture and into the circulation chamber during inhalation;

disposing a first flat endcap insert of the plurality of first flat endcap inserts between the first chamber housing end and the first endcap;

breathing through the mouth piece of the oxygen trainer assembly;

removing the first flat endcap insert from between the first chamber housing end and the first endcap;

disposing a second flat endcap insert of the plurality of first flat endcap inserts between the first chamber housing end and the first endcap wherein the second flat endcap insert is thicker than the first flat endcap insert to provide more resistance to air flow than the first flat endcap insert.

* * * * *